US006814013B2

(12) United States Patent
Martin et al.

(10) Patent No.: US 6,814,013 B2
(45) **Date of Patent: *Nov. 9, 2004**

(54) PROCESS FOR TREATING INCINERATION RESIDUES FROM AN INCINERATION PLANT

(75) Inventors: Johannes Martin, München (DE); Oliver Gohlke, München (DE); Joachim Horn, Dietramszell (DE); Michael Busch, Rosenheim (DE)

(73) Assignees: Martin GmbH für Umwelt-und Energietechnik, Munich (DE); Mitsubishi Heavy Industries, Ltd., Chiyoda-Ku ( * ) Notice: Subject to any disclaimer, the term of this patent is extended or adjusted under 35 U.S.C. 154(b) by 0 days.

This patent is subject to a terminal disclaimer.

(21) Appl. No.: 10/401,007

(22) Filed: Mar. 27, 2003

(65) Prior Publication Data

US 2003/0183137 A1 Oct. 2, 2003

(30) Foreign Application Priority Data

Mar. 27, 2002 (DE) ..... 102 13 789

(51) Int. Cl.[7] ..... F23J 1/00
(52) U.S. Cl. ..... 110/344; 110/165 R; 110/266
(58) Field of Search ..... 110/165 A, 165 R, 110/246, 266, 346, 235, 344; 210/195.1; 588/257; 432/16; 75/414, 500; 241/20; 423/210

(56) References Cited

U.S. PATENT DOCUMENTS 3,745,941 A * 7/1973 Reilly ..... 110/346
4,932,336 A * 6/1990 Srowig et al. ..... 110/346
5,143,304 A 9/1992 Schwyter ..... 241/19
5,671,688 A * 9/1997 Burgin et al. ..... 110/344
6,095,064 A * 8/2000 Millard et al. ..... 110/344
6,145,453 A * 11/2000 Martin et al. ..... 110/346
6,199,492 B1 * 3/2001 Kunstler ..... 110/342
6,309,338 B1 * 10/2001 Christensen ..... 588/257

FOREIGN PATENT DOCUMENTS

DE 701 606 1/1941
DE 4429958 A1 * 2/1996 ..... F23G/5/00

* cited by examiner

*Primary Examiner*—Kenneth Rinehart
(74) *Attorney, Agent, or Firm*—Cohen, Pontani, Lieberman & Pavane

(57) ABSTRACT

In the process for treating incineration residues from waste incineration plants, the incineration material is incinerated on a furnace grate. The incineration residues produced are quenched in a wet slag remover and conveyed out of the latter. The wet incineration residues which come out of the wet slag remover are firstly divided into two fractions by means of a screening operation, after which the main fraction is washed with water taken from the wet slag remover, and in the process adhering fine pieces are separated off. The washed pieces of the incineration residues are fed for reuse. The washing water together with the ultra fine pieces which have been taken up during the washing operation pass into the wet slag remover. The fine fraction produced during the mechanical separation operation is fed back to the incineration operation.

19 Claims, 5 Drawing Sheets

PROCESS FOR TREATING INCINERATION RESIDUES FROM AN INCINERATION PLANT

BACKGROUND OF THE INVENTION

1. Field of the Invention

The invention relates to a process for treating incineration residues from an incineration plant, in particular a waste incineration plant, in which the incineration material is incinerated on a furnace grate, and the incineration residues produced are quenched in a wet slag remover and are conveyed out of the latter.

2. Description of the Related Art

It is known from DE 701 606 C to convey the incineration residues into a slag remover, which has an introduction chute and a slag removal vessel with rising discharge spout and from there to remove the incineration residues by means of a discharge ram. In the process, the water for quenching the slag is fed to the slag removal vessel, only the same amount of fresh water being introduced into this slag removal vessel as is discharged with the slag on account of its moisture content. In this case, an equilibrium concentration is established with regard to numerous substances and compounds, e.g. salts, which are present in the residues, so that it is impossible to lower their concentration. This results in the slag having unsatisfactory properties with regard to its ability to form landfill and to be processed further to form construction materials. Another reason for this drawback is that there is no division or classification of the incineration residues into fractions with better properties and those with worse properties, and consequently the incineration residues produced as a whole inevitably have unsatisfactory properties.

It is known from DE 44 23 927 A1 to feed the incineration residues which come out of a furnace directly, without prior quenching in a water bath, to the primary cleaning stage. The dry slag which has undergone primary cleaning is separated into at least two fractions. All the particles which are smaller than 2 mm are allocated to a first fraction, and the remaining particles are allocated to a second fraction. As this process continues, the second fraction is in turn separated, in a screening stage, into at least two fractions, and all the particles which are smaller than 27 to 35 mm are allocated to a third fraction, while the remaining particles are allocated to a fourth fraction. In this way, fractions of incineration residues with satisfactory properties are obtained. Drawbacks of this process are the considerable amounts of dust produced and problems with achieving an airtight closure of the incineration chamber.

SUMMARY OF THE INVENTION

It is an object of the invention to provide a process which facilitates the separation and increase in the content of usable slag from incineration residues and specifically in which the drawbacks of dust being formed and the airtight closure of the incineration chamber are avoided with a low level of outlay on equipment and a low water consumption.

This object is achieved, starting from the process explained in the introduction, in two different ways depending on the composition of the incineration material.

According to the invention, the first process variant consists in the fact the wet incineration residues which come out of the wet slag remover are firstly divided into two fractions by means of a mechanical separation operation, after which the main fraction, which substantially includes a coarse fraction and an oversize fraction, is washed with water taken out of the wet slag remover, and in the process adhering finer pieces are separated off, and that the washing water together with the finer parts which it has taken up during the washing operation is fed to the wet slag remover.

This process variant is used whenever it can be assumed that the main fraction to be reutilized contains a low level of pollutants which can be washed out, such as for example salts or heavy metals.

With this method of circulating the water originating from the wet slag remover, the main fraction, which has good quality properties, has the adhering fine pieces, which experience has shown have an adverse effect on the quality of the main fraction, removed from it without relatively large quantities of fresh water having to be used, so that the incineration residues are present in the form of slag with good-quality properties for further processing.

In a second process variant, which is used whenever it is expected that there will be a relatively high level of pollutants which can be washed out, such as for example salts or heavy metals, in the incineration residues produced, the treatment is carried out in such a way that the wet incineration residues which come out of the wet slag remover are firstly divided into two fractions by means of a mechanical separation operation, after which the main fraction which has been separated off and substantially includes a coarse fraction and an oversize fraction if subjected to a comminution operation and is then washed with water taken from the wet slag remover, and that the washing water together with the relatively fine pieces which it has taken up during the washing operation is fed to the wet slag remover. The result of the comminution of the main fraction is that during the subsequent washing operation, the pollutants which are included in the relatively large pieces of the incineration residues are washed out and can in this way be separated from the main fraction which can be reutilized, with the result that, despite these incineration residues being relatively highly laden with pollutants, a large proportion of the incineration residues can be obtained as reusable slag without it being necessary to anticipate relatively large amounts of pollutants being washed out at a later stage.

In a further configuration of the invention, the fine fraction and ultra fine fraction produced during the mechanical separation are fed to the incineration operation. These fractions are once again subjected to an incineration operation, so that it is possible to fuse and sinter these fractions.

These measures avoid the drawbacks of the procedure explained first, in which all the incineration residues can only be fed for reutilization if, by chance, the levels of materials with relatively poor properties are low. Compared to the second known process, the drawback of the formation of dust and also the drawback of sealing the incineration chamber are avoided. Moreover, the return of the fine fraction and ultra fine fraction which have relatively poor quality properties additionally increases the proportion of the incineration residues which can be reutilized, since the fine pieces which are returned, after they have been returned one or more times, have the opportunity to agglomerate to form incineration residues which have the desired properties. This advantage is likewise not present in the second known process, on account of the absence of this return step.

If, in a further configuration of the invention, the main fraction which has been prewashed with water from the wet slag remover is rinsed further with fresh water, the slag remover water, which has a relatively high level of pollutants, is rinsed off and the quality of the incineration residues or of the sintered slag is improved further. The use of fresh water to further rinse the coarse fraction also brings the advantage that, as a result, at least some of the water which comes out of the further rinsing stage can be fed to the off-gas purification without this water having to undergo preliminary purification, since the level of pollutants is relatively low. Furthermore, it may be advantageous for at least some of the water which comes out of the further rinse to be fed to the wet slag remover. In this way, the level in the wet slag remover can be maintained, since the quantity of incineration residues discharged always entrains water, with the result that the quantity of water in the wet slag remover decreases and would in any case have to be topped up. Since the water which comes out of the further rinsing stage has only low calcium and sulfate contents, there is no risk of lines or nozzles becoming blocked.

If, in the first separation operation according to the first process variant, the main fraction still contains high levels of an oversized fraction, which usually has a high scrap content, it is possible, in a further configuration of the invention, for the coarse fraction to be subjected to a further mechanical separation operation.

In the text which follows, it is stated, purely by way of example with a view to illustrating the respective ranges and without implying any restriction to the invention, that the ultra fine fraction is to have a grain size of approximately 0 to 2 mm, the fine fraction is to have a grain size of approximately 2 to 8 mm, the coarse fraction is to have a grain size of approximately 8 to 32 mm and the oversized fraction is to have a grain size of approximately over 32 mm. These values are only given to allow an improved understanding as what guidelines; of course, each fraction may contain a certain proportion of the finer fraction below it, provided that the finer constituent is of subordinate importance. It is usual for the fine fraction, which comes directly out of the slag remover and has a grain size of approximately 2–8 mm, to form the proportion of incineration residues which is preferably fed back to the incineration operation. In the second process variant, however, the comminution operation results in the formation of a grain fraction which corresponds to this fine fraction in terms of its grain size distribution but is of a higher standard in terms of its quality for further utilization, and consequently this fine fraction can be referred to as a quality fine fraction.

Therefore, if, for example working on the basis of the first process variant, the first coarse separation maintains a separation limit of 32 mm, i.e. if the oversize fraction has been separated out, it is recommended to provide a second mechanical separation step, which then takes place, for example, at 8 mm, in which all the pieces which are smaller than 8 mm are fed back to the incineration operation.

To prevent mechanical separation devices from being damaged by large pieces of scrap, it is recommended for metals to be separated out from the main fraction.

The main fraction, which comprises an oversize fraction and a coarse fraction, can in this way have not only the large pieces of scrap but also all other metal parts, which are fed for separate utilization, removed from it.

Depending on the procedure and on the intended further utilization of the incineration residues produced, and also depending on the composition of these incineration residues, it may be expedient for metals to be separated off from the oversize fraction and coarse fraction separately from one another.

If, by way of example, the incineration residues are to be used in road building, it is recommended that, after the metals have been separated off, the oversize fraction be subjected to a further comminution operation, since pieces, by way of example, larger than 32 mm are relatively unsuitable for this intended use.

Working on the basis of the first process variant, with a view to providing the largest possible fraction for further utilization, it is expedient if, in a further configuration of the invention, the coarse fraction which has been separated from the main fraction is mixed with the comminuted incineration residues from the oversize comminution step to form a first mixed fraction. In this context, it may prove advantageous for the mixed fraction to be subjected to a mechanical separation operation, since the comminution operation also produces grain sizes which are undesirable for further utilization and which, by way of example, need to be fed back to the incineration operation.

If the incineration residues are to be prepared for a field of application which is of particular interest, namely the production of sub-base layers for road building, it must be possible for the material to be compacted, which is difficult to achieve without a fine fraction which is between 2 and 8 mm according to the coarse division given above. For this reason, it is recommended for some of the coarse fraction to be subjected to a comminution operation, in order to deliberately produce this required fine fraction, so that there is no need to rely on the production of this grain size purely by chance. It is advantageous for approximately 30% of the coarse fraction to be subjected to this comminution operation. The ultra fine fraction and fine fraction which are formed during the comminution of the coarse fraction are mixed with the coarse fraction to form a second mixed fraction. It is preferable for the proportion of the coarse fraction in this mixed fraction which is intended for road building to amount to approximately 70%.

A grain fraction of larger than 8 mm is predominant in this second mixed fraction, since experience has shown that these constituents have the quality required for further utilization, while a smaller proportion of a grain fraction of between 2 and 8 mm is required in order to ensure that these incineration residues can be compacted as mentioned above for the purpose of road building.

If, in a further configuration of the invention, the second mixed fraction is washed with water from the wet slag remover and the ultra fine fraction is separated off, it is ensured that the fractions with the grain size of less than 2 mm, which often contain particularly high levels of pollutants, are separated from the fractions which can be reutilized.

This washing water can advantageously then be fed back to the wet slag remover, as has also been explained above in a different context. The aim and purpose of this return step are in connection with consuming the minimum possible amounts of fresh water.

It is recommended for the metals which have been separated off to be subjected to a wash using water from the slag remover water, so that any remaining incineration residues are washed off.

It is advantageous for a screening operation to be used as a mechanical separation operation.

It is extremely expedient, with a view to increasing the quality of the incineration residues obtained, if precipitating agents for soluble heavy metals are added to the water of the wet slag remover. As a result, these heavy metals can be separated out.

The invention is explained in more detail below with reference to various flow diagrams, which show exemplary embodiments of the process according to the invention.

DETAILED DESCRIPTION OF THE PREFERRED EMBODIMENTS

Figure 1:
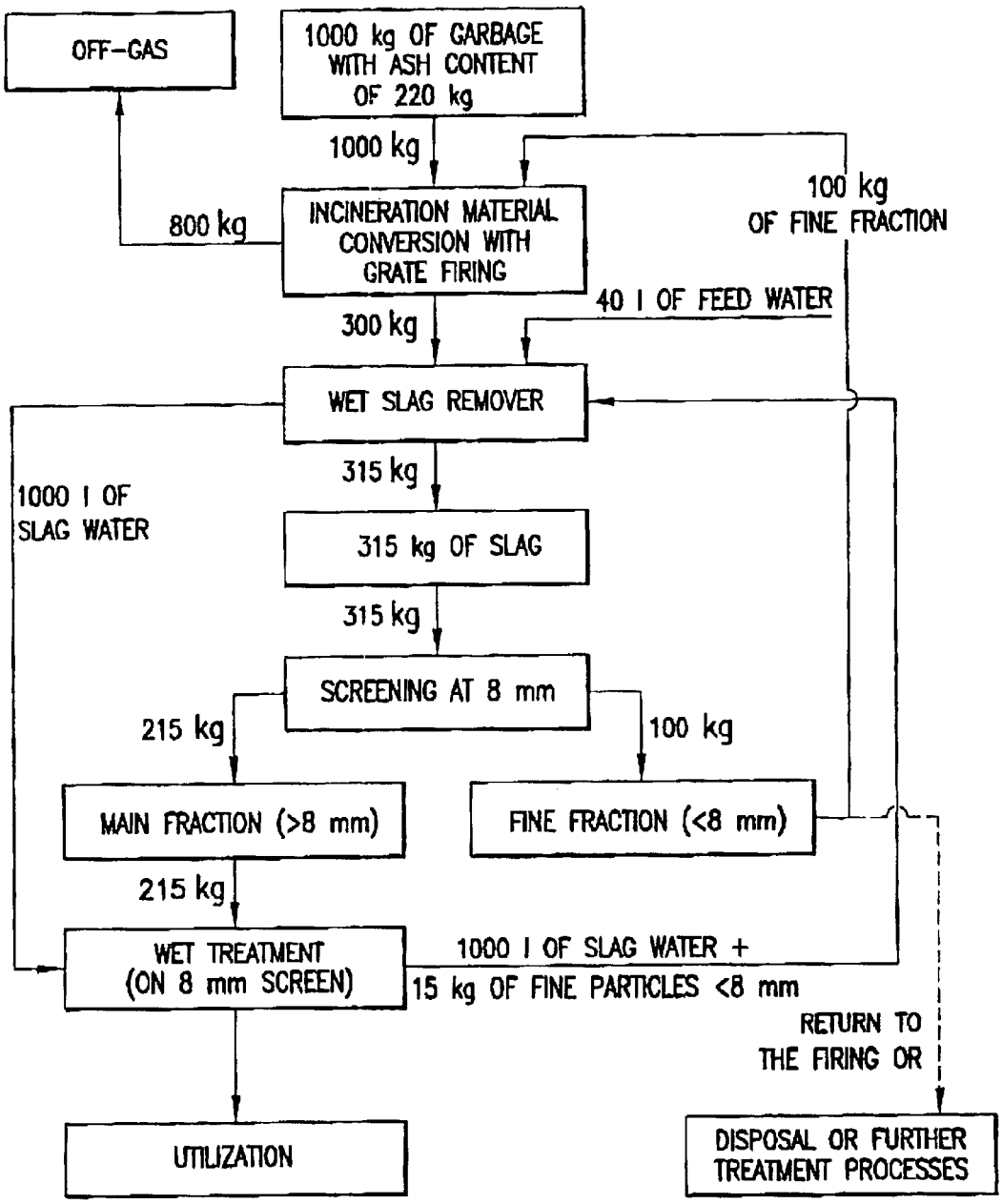
FIG. 1 shows a flow diagram of a basic process.

As can be seen from FIG. 1, 1000 kg of garbage with an ash content of 220 kg are added to a grate firing and are incinerated. During this incineration operation, 800 kg of off-gas and 300 kg of incineration residues are formed. The latter pass into a wet slag remover, from which, on account of the wetting, 315 kg of incineration residues or slag are discharged. These incineration residues are subjected to a mechanical separation step, in the present case to screening at 8 mm. In this step, 215 kg of incineration residues or slag as the main fraction with a grain size of over 8 mm, firstly, and a fine fraction and ultra fine fraction of <8 mm, amounting to 100 kg, are separated from one another. The slag with a grain size of over 8 mm, which comprises a coarse fraction and an oversize fraction, is subjected to a wet treatment, in which, specifically, 1000 liters of water are removed from the wet slag remover, in order to wash this slag and in the process wash off some 15 kg of fine constituents with a size of smaller than 8 mm. This wash can expediently take place on a screen with an underflow size of 8 mm or smaller. The slag water in combination with these fine fractions and ultra fine fractions is fed back to the wet slag remover. The washed slag is removed and taken for utilization, for example in road building. The fine fraction with a mass of approximately 100 kg which was separated off during the screening is usually returned to the grate firing in order to undergo further sintering. However, it is also possible for this fraction to be fed to other treatment processes. 40 liters of feed water or fresh water are supplied, in order to compensate for the water loss in the wet slag remover, which occurs as a result of the incineration residues naturally entraining liquid when they are discharged from the wet slag remover.

Figure 2:
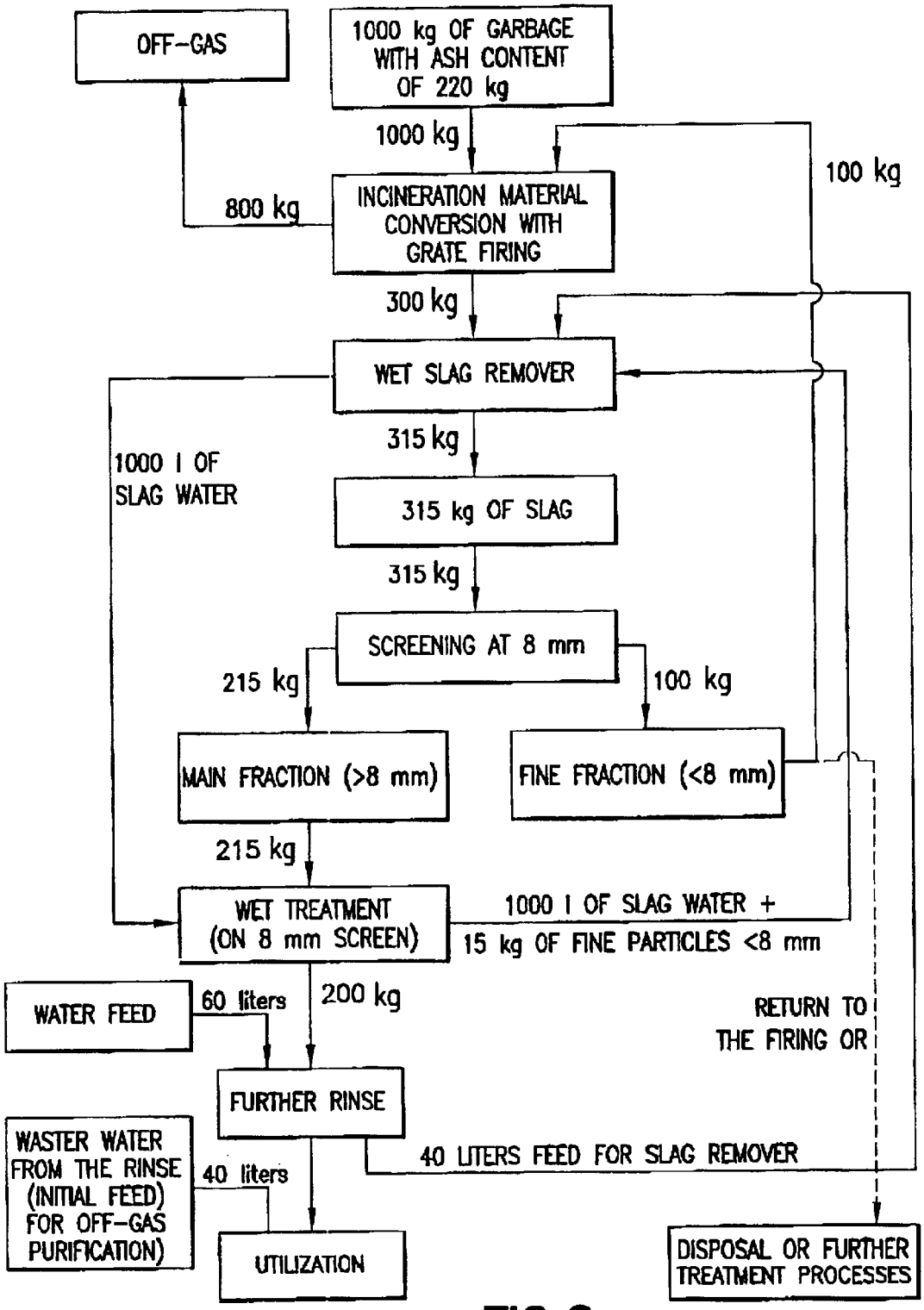
FIG. 2 shows a flow diagram of the basic process with an additional further rinse.

In the modification of the process which is shown in FIG. 2, after the wet treatment of the main fraction with a grain size of over 8 mm, a further rinse is carried out using fresh water, which is added to the 200 kg of the main fraction in an amount of 80 liters, in order to remove adhering constituents which originate from the wet treatment by means of the water from the wet slag remover. 40 liters of this rinsing liquid are branched off for the off-gas purification or disposal in some other way, while a further 40 liters are fed to the wet slag remover to compensate for the water loss. The slag which has been cleaned in this way can be fed for further utilization.

Figures 3, 3A, 3B:
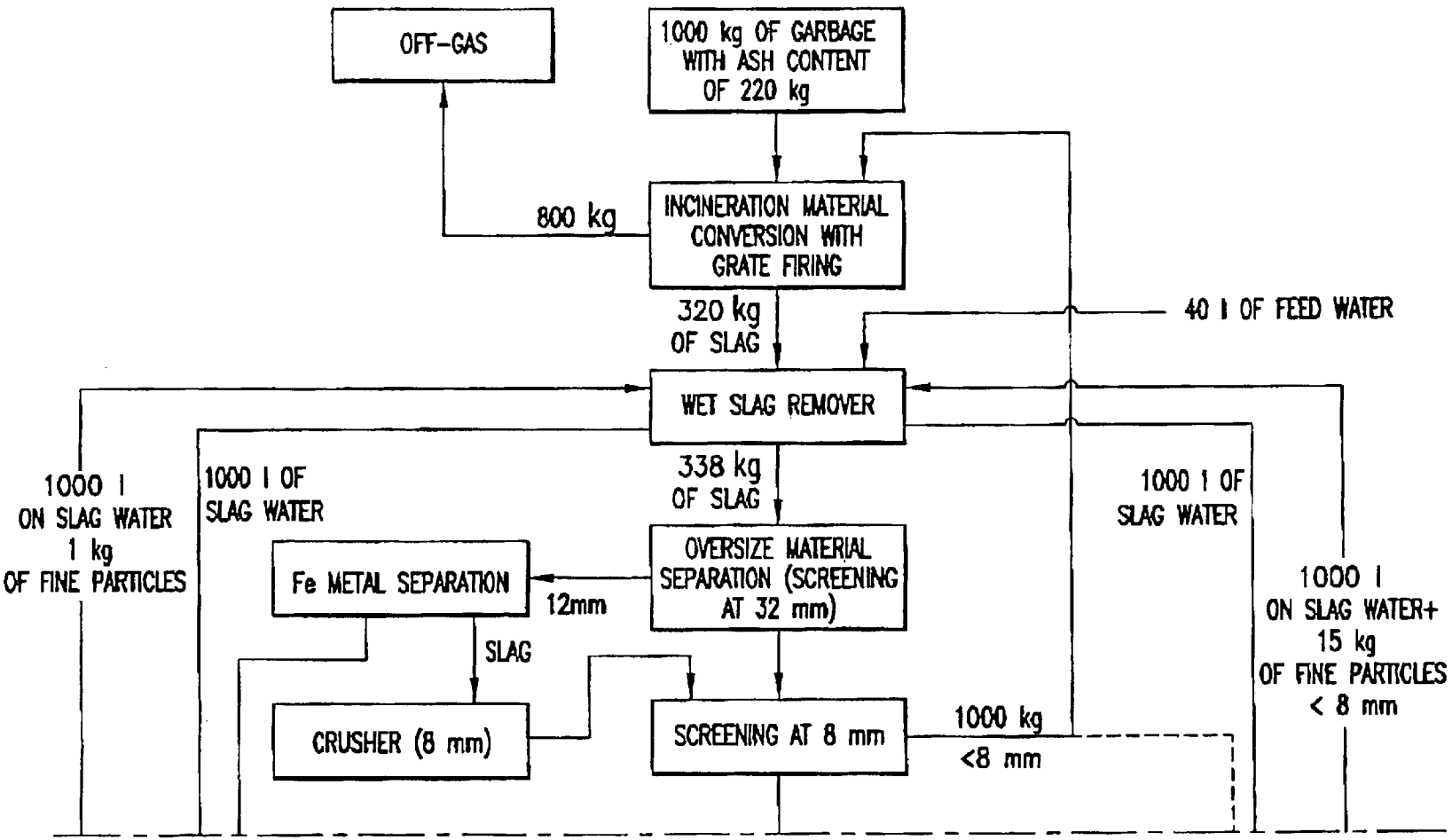
FIG. 3 shows a flow diagram of a variant of the basic process with additional process steps.
Figure 3B:
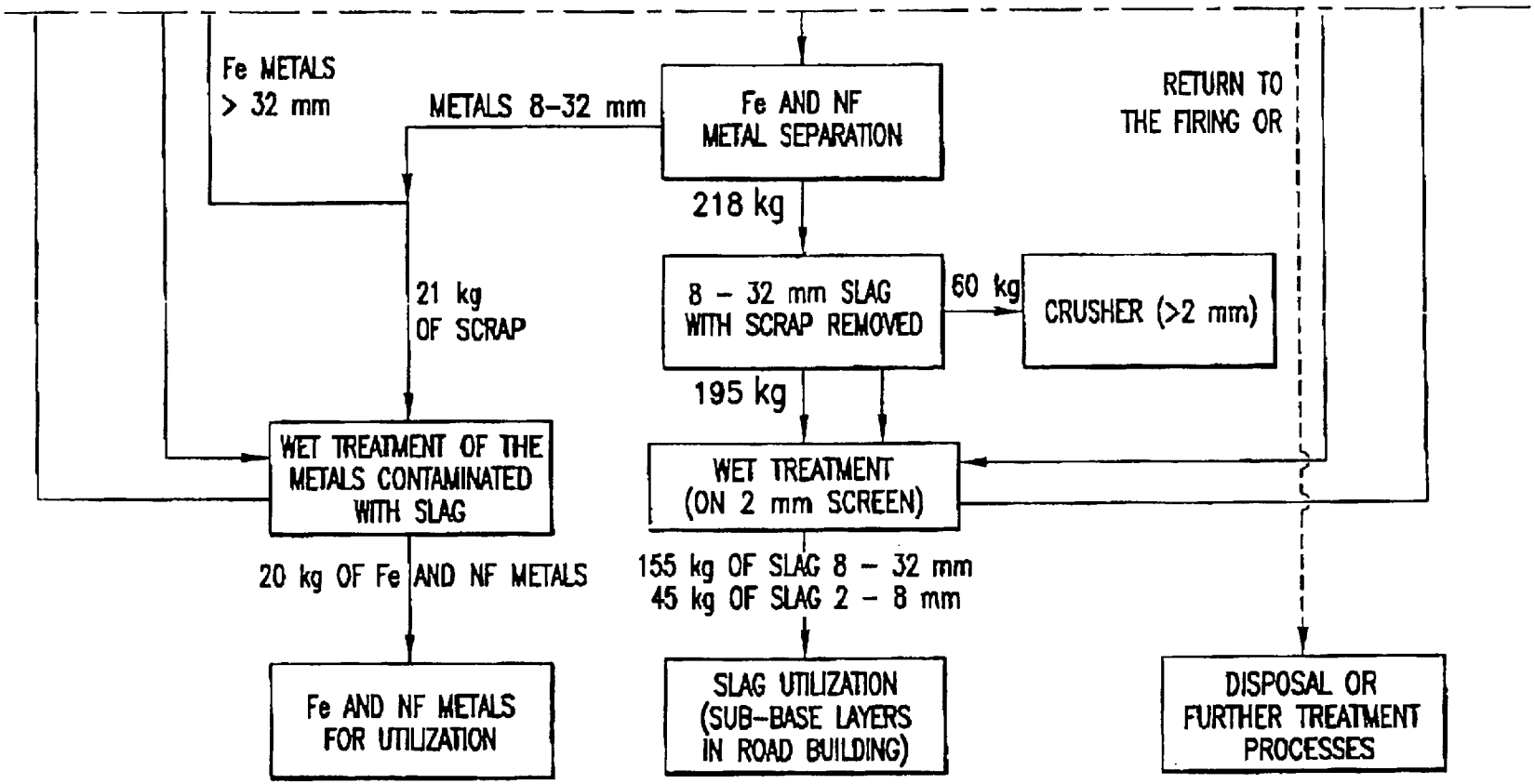

FIG. 3 shows a variant of the process according to the invention. In this altered process, 1000 kg of garbage with an ash content of 220 kg are fed to a grate firing. During the incineration, 800 kg of off-gas and 320 kg of incineration residues, which pass into a wet slag remover, are formed. Around 336 kg of incineration residues are removed from the wet slag remover. The increase in weight results from fine particles which are supplied to the wet slag remover via the recirculation of slag water. 40 liters of water are fed to the wet slag remover to compensate for the water which has been discharged. The 336 kg of slag or incineration residues pass onto a screen with a separation grain size of 32 mm. The oversize fraction with a grain size of >32 mm is first of all fed to a metal separation step. The slag produced in the process passes into a crusher, in order to obtain slag of the order of magnitude of 8 mm. This slag obtained in this way is placed onto a further screen with a separation grain diameter of 8 mm. 100 kg of slag or incineration residues with a grain diameter of <8 mm are removed from this mechanical separation step and are preferably returned to the grate firing stage. The remaining, coarser fraction is passed to a metal separation stage. The pieces of metal obtained and the pieces of metal from the metal separation step from the process step described above are combined and are fed to a wet treatment, in order to rinse off adhering pieces of slag. This step produces 20 kg of ferrous and nonferrous metals, which are fed for utilization. The slag or coarse fraction with a grain size of 8 to 32 mm, from which scrap has been removed, weighs 215 kg. 60 kg of this is fed to a crusher and comminuted to a grain size of >2 mm. After the comminution, the comminuted material is fed to the main stream of 155 kg and subjected to a wet treatment on a screen with a separation grain size of 2 mm. The washing water is removed from the wet slag remover in an amount of 1000 liters. After this wet treatment, 155 kg of slag with a grain size of from 8 to 32 mm and a finer fraction amounting to 45 kg with a grain diameter of 2 to 8 mm are present. These two fractions are fed for further utilization, while fine fractions which have a diameter of less than 2 mm are fed back to the wet slag remover.

Figure 4:
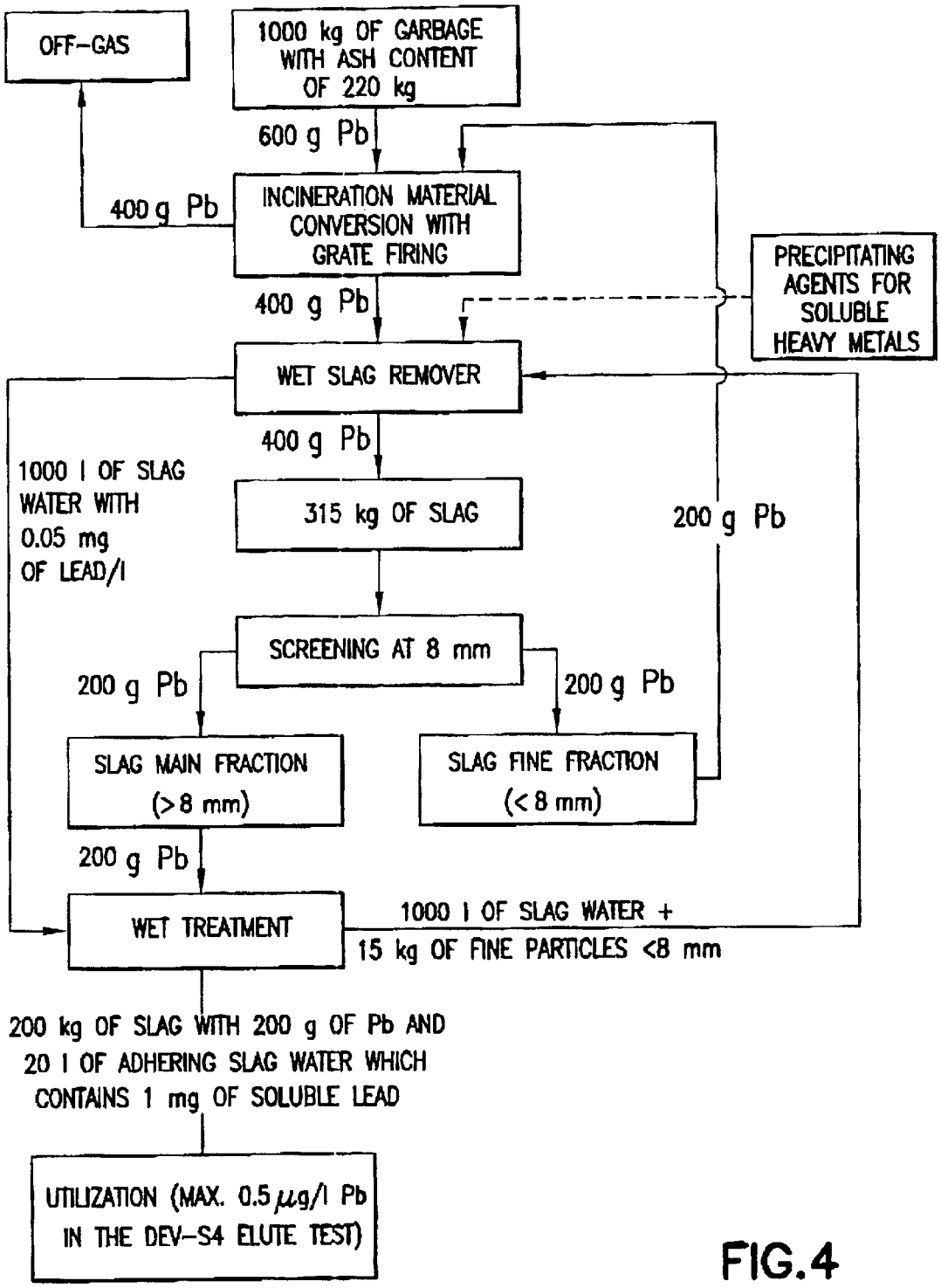
FIG. 4 shows a flow diagram of the basic process with the additional precipitating agents.

The flow diagram shown in FIG. 4 shows the basic variant, corresponding to that shown in FIG. 1, in combination with the addition of a precipitating agent for soluble heavy metals. This precipitating agent is added to the wet slag remover in order to reduce the lead content of the slag remover water from the usual level of 2 mg/l to 0.05 mg/l. As a result, the level of dissolved lead which is present with approx. 20 l of slag water adhering to 200 kg of wet-treated slag is reduced to 1 mg. 400 g of lead is passed into the off-gas during the incineration. During the mechanical separation operation with a separation grain size of 8 mm, the 400 g of lead are divided in such a way that 200 g of lead remains in the slag amounting to 200 kg which is fed for reutilization after the wet treatment, while 200 g of lead are returned to the grate firing with the fine fraction of smaller than 8 mm.

What is claimed is:

1. A process for treating incineration residues from an incineration plant, said process comprising:

incinerating incineration material in an incineration zone on a furnace grate to produce incineration residues and fly ash;

quenching said incineration residues in a wet slag remover;

conveying said residues out of said wet slag remover;

mechanically separating said incineration residues into fractions including a main fraction comprising a coarse fraction and an oversize fraction;

washing said main fraction with washing water taken out of said wet slag remover, thereby separating off finer pieces adhering to said main fraction; and feeding said washing water together with said finer pieces to said wet slag remover.

2. A process as in claim 1 further comprising comminuting said main fraction after separating and prior to washing.

3. A process as in claim 1 wherein said mechanically separating further produces a fine fraction and an ultrafine fraction which are fed to said incineration zone.

4. A process as in claim 1 further comprising rinsing said main fraction with fresh rinsing water after washing said main fraction with washing water taken out of said wet slag remover.

5. A process as in claim 4 further comprising feeding at least some of said rinsing water to an off-gas purification after rinsing.

6. A process as in further comprising feeding at least some of said rinsing water to the wet slag remover after rinsing.

7. A process as in claim 1 further comprising separating metal from said main fraction.

8. A process as in claim 1 further comprising subjecting said main fraction to a further mechanical separation.

9. A process as in claim 7 wherein metal is separated from said oversize fraction and said coarse fraction separately.

10. A process as in claim 1 further comprising comminuting said oversize fraction.

11. A process as in claim 10 further comprising mixing said coarse fraction with the comminuted oversize fraction to produce a first mixed fraction.

12. A process as in claim 11 further comprising mechanically separating said first mixed fraction.

13. A process as in claim 1 further comprising comminuting said part of said coarse fraction to produce a fine fraction and an ultrafine fraction.

14. A process as in claim 13 wherein said fine fraction and said ultrafine fraction produced by comminuting said coarse fraction are mixed with the coarse fraction to produce a second mixed fraction.

15. A process as in claim 14 further comprising washing said second mixed fraction with water from said slag remover, and separating off said ultrafine fraction.

16. A process as in claim 15 wherein said ultrafine fraction is fed with said washing water to the wet slag remover.

17. A process as in claim 7 further comprising washing the metals which have been separated out with water from said slag remover.

18. A process as in claim 1 wherein said mechanically separating comprises screening.

19. A process as in claim 1 further comprising adding precipitating agents for soluble heavy metals to said washing water.

* * * * *